United States Patent [19]

Petersen et al.

[11] Patent Number: 4,502,855

[45] Date of Patent: Mar. 5, 1985

[54] ROTARY PISTON MACHINE WITH PARALLEL INTERNAL AXES

[75] Inventors: Hans C. Petersen; Svend E. Thomsen, both of Nordborg, Denmark

[73] Assignee: Danfoss A/S, Nordborg, Denmark

[21] Appl. No.: 550,317

[22] Filed: Nov. 10, 1983

[30] Foreign Application Priority Data

Nov. 24, 1982 [DE] Fed. Rep. of Germany ..... 3243394

[51] Int. Cl.[3] ..... F04C 2/10; F04C 15/02

[52] U.S. Cl. ..... 418/15; 418/61 B; 418/186

[58] Field of Search ..... 418/15, 61 B, 186

[56] References Cited

U.S. PATENT DOCUMENTS

| | | | |
|---|---|---|---|
| 1,972,302 | 9/1934 | Hutchison | 418/186 |
| 3,106,163 | 10/1963 | Mosbacher | 418/61 B |
| 3,233,524 | 2/1966 | Charlson | 418/61 B |
| 3,775,031 | 11/1973 | Hansen | 418/61 B |
| 3,876,343 | 4/1975 | Giversen | 418/186 |
| 4,145,167 | 3/1979 | Baatrup | 418/186 |
| 4,264,288 | 4/1981 | Wusthof et al. | 418/61 B |

FOREIGN PATENT DOCUMENTS

| | | | |
|---|---|---|---|
| 54161 | 6/1982 | European Pat. Off. | 418/61 B |

*Primary Examiner*—John J. Vrablik
*Assistant Examiner*—T. Olds
*Attorney, Agent, or Firm*—Wayne B. Easton

[57] ABSTRACT

A gerotor type star and ring gear machine in which control orifices in the star gear alternatively register with ports in the end wall. The star gear is formed from a series of plates and has two sets of control orifices formed therein with one set being diametrically opposed to the second set.

14 Claims, 11 Drawing Figures

Figure 3:
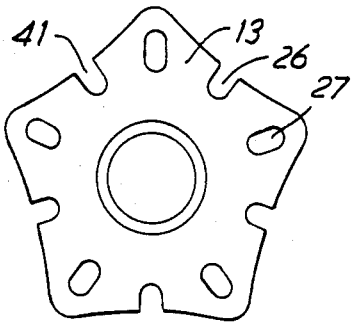
Figure 4:
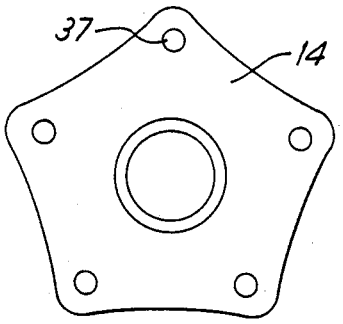
Figure 5:
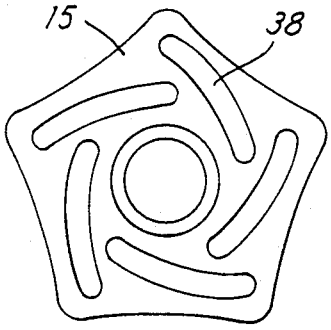
Figure 6:
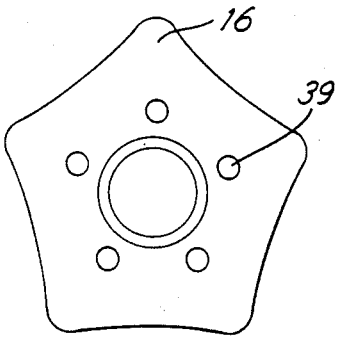
Figure 7:
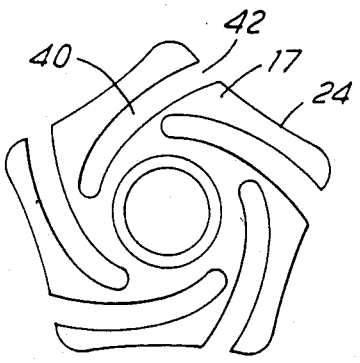
Figure 8:
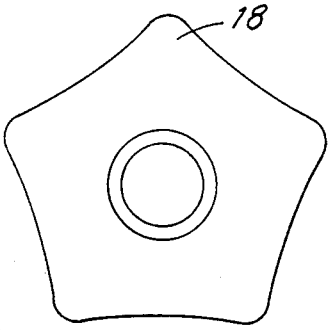

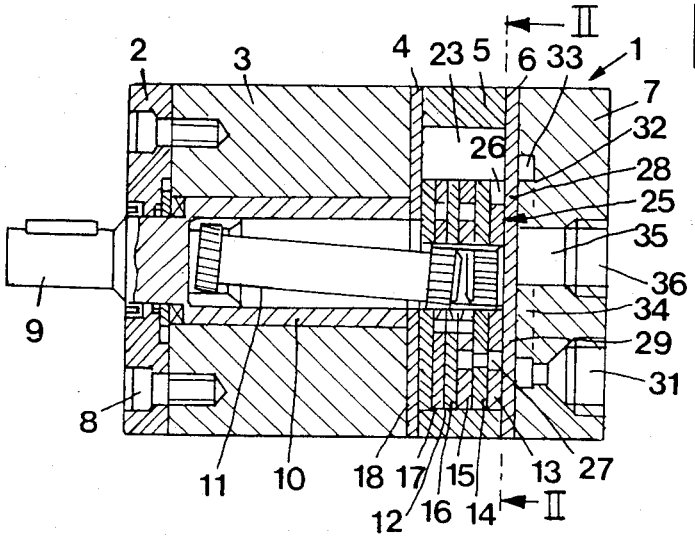
Fig.1
Fig.2
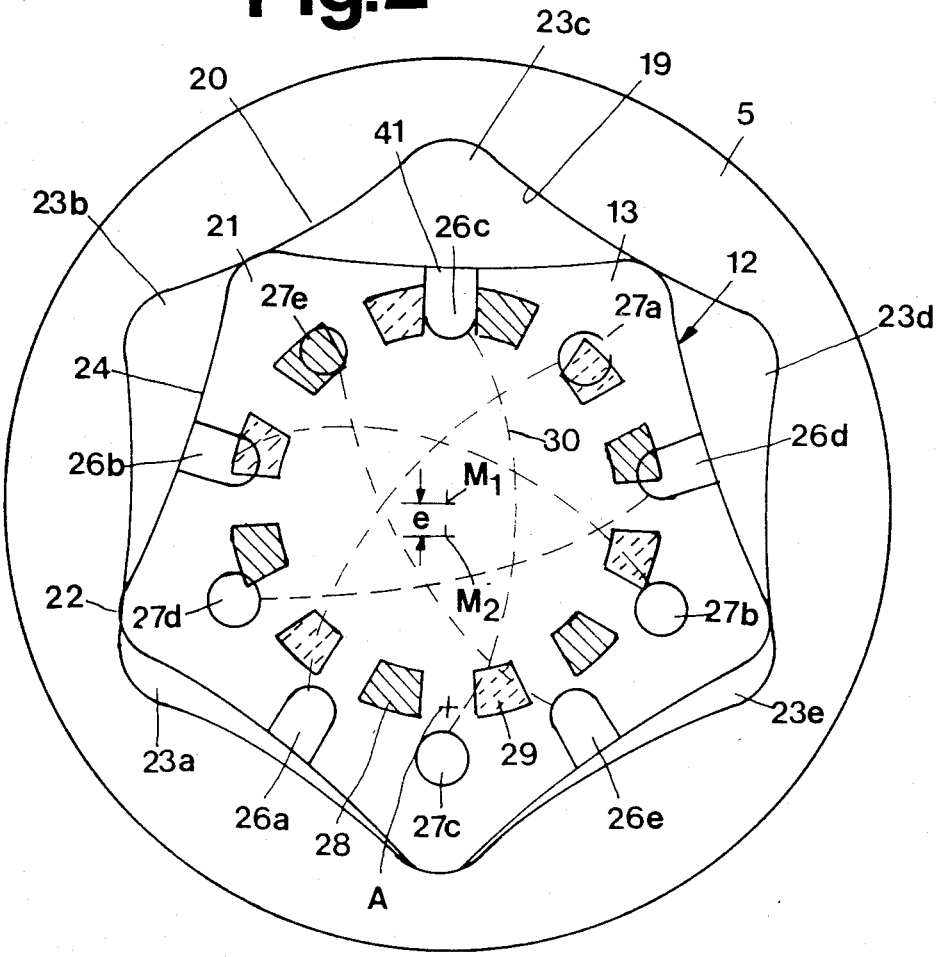

ROTARY PISTON MACHINE WITH PARALLEL INTERNAL AXES

The invention relates to a rotary piston machine with parallel internal axes comprising an externally toothed and an internally toothed gear which form compression chambers between each other, turn and planetate relatively to each other and of which one is fixed to turn with a main shaft, and a distributing valve having two sets of control orifices co-operating in at least one plane normal to the gear axes, the control orifices of the first set being fixed to a first gear and leading to openings lying in substantially the same radial direction at the circumference of said gear and the control of the orifices of the second set being fixed to the second gear and leading circumferentially alternately to the pressure of vacuum connection, wherein in particular the externally toothed gear rotates and planetates and carries the control orifices of the first set at its end.

In a known rotary piston machine of this kind (No. DE-AS 21 55 818) the teeth of the internal gear are formed by five cylindrical rollers whereas the external gear has four teeth and a trocoidal peripheral surface. In the region between the teeth, the external gear has at one end grooves of triangular cross-section which define four control orifices of the first set and co-operate with ten control orifices of the second set which are alternately connected to the pressure and vacuum sides and are disposed in an adjoining and wall connected to the internally toothed gear. The grooves also form a short passage with an opening at the periphery of the external gear. In this construction, all parts of the rotary piston machine particularly the control orifices of the distributing valve, must be very accurately fabricated so that switching over from pressure to vacuum and vice versa will always take place at the correct instant.

The invention is based on the problem of providing a rotary piston machine of the aforementioned kind of which the operation is less sensitive to manufacturing inaccuracies, particularly in the case of the control orifices of the distributing valve.

This problem is solved according to the invention in that each control orifice of the first set is associated with an auxiliary control orifice which is connected to the same periperhal section and disposed on the opposite side of the central axis of the associated gear.

By using the additional auxiliary control orifices of the first set, a control orifice is always available for switching over from pressure to vacuum and vice versa and has a large spacing from the instantaneous centre of rotation and thus a correspondingly high rotary speed. Manufacturing inaccuracies are practically immaterial with regard to the instant of switching over. This has the advantage that fewer pressure peaks and noises occur and there is smoother running. Another advantage is that gears of comparatively small dimensions can be employed in which the trocoidal path on which the control orifices and the auxiliary control orifices of the first set move relatively to those of the second set reverses its direction in the vicinity of the instantaneous centre of rotation and forms a loop.

In particular, the control orifice and associated auxiliary control orifice of the first set should be relatively offset by 180°. This gives optimum conditions.

It is particularly favourable if the first gear has an odd number of teeth. One control orifice in the region between the teeth and one auxiliary control orifice in the tooth region will then lie opposite each other. The control orifices can be disposed comparatively close to the periphery of the first gear and one nevertheless obtains an adequate seal of the auxiliary control orifices relatively to the adjacent compression chambers.

In addition, it is possible to provide the control orifices and auxiliary control orifices of the first set on the same end face of the first gear. This is a constructional simplification.

In an alternative form, the first gear has an even number of teeth and has the control orifices of the first set at its one end face and the auxiliary control orifices of the set at its other end face. This makes it possible to work with an even number of teeth.

With particular advantage, the control orifices of the second set have the same spacing from the axis of the second gear and this spacing is somewhat smaller than that of the control orifices and auxiliary control orifices of the first set from the axis of the first gear.

This not only simplifies manufacture but also provides better operation. The control orifices of the first set disposed near the instantaneous centre of rotation are disposed beyond the circle of control orifices of the second set, so that the associated compression chamber is supplied solely by the rapidly moving control orifice which therefore brings about positive switching over.

From a constructional point of view, it is favourable that the toothed first gear should consist of a plurality of superposed plates, that the first plate has the control orifices of the first set on an outer circle between the respective teeth and in the form of an incision which defines a first opening and opens towards the periphery and has the auxiliary control orifices in the the tooth region in the form of an aperture, that a distributing plate has second openings with adjoining passage sections, and that between the first plate and the distributing plate at least two apertured plates with holes on respective inner and outer circles and at least one passage plate with passage sections connecting two circumferentially offset holes on different circles are so alternately arranged that each second opening is connected to a substantially diametrally opposite aperture. In this way, it is possible to produce a gear with little expense that has twice the number of control orifices on one side as well as the corresponding number of passages for connecting to the associated openings at the periphery.

If the periphery of the one gear has, between operative sections coming into contact with the other gear, inoperative sections which do not come into contact with the other gear, it is recommended that the inoperative sections be on the first gear and contain the openings connected to the control orifices and auxiliary control orifices of the first set. This prevents the openings connected to these control orifices from producing a short circuit between the chambers of different pressure when the pressure is changed in the respective maximum or minimum compression chambers. One thereby obtains a higher efficiency for the machine.

Figure 9:
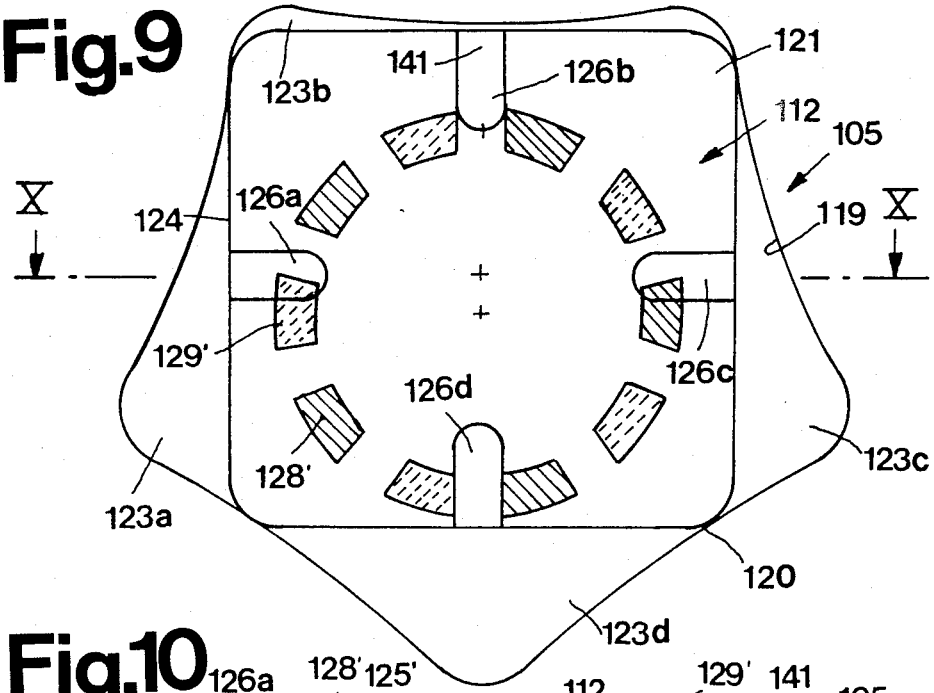
Figure 10:
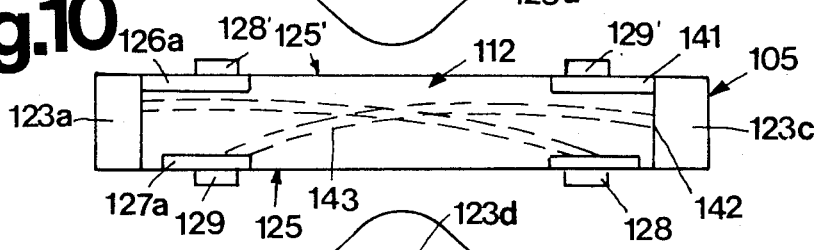
Figure 11:
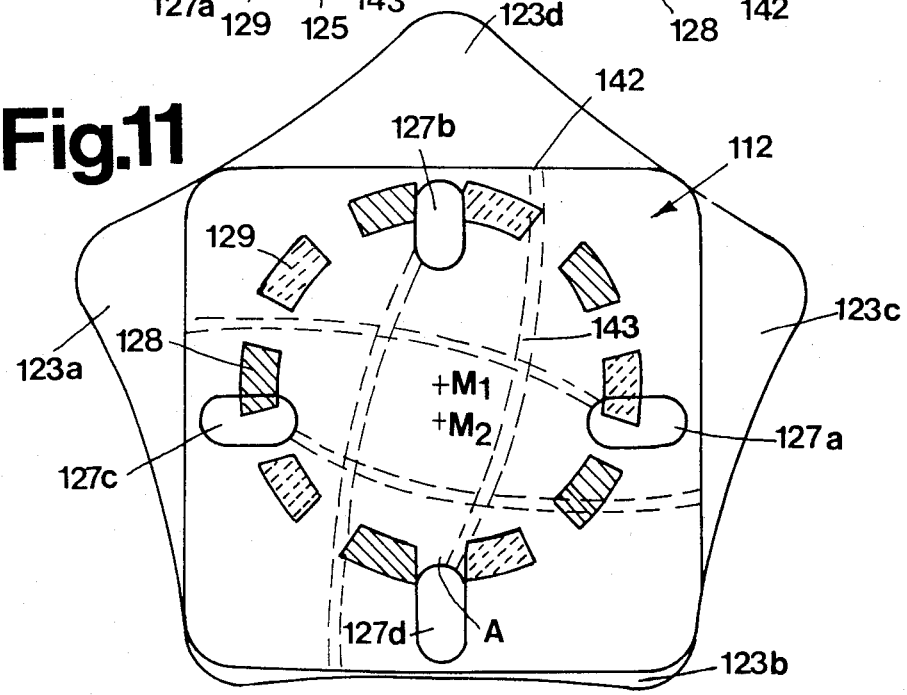

A preferred example of the invention will now be described in more detail with reference to the drawing wherein:

FIG. 1 is a diagrammatic longitudinal section through a rotary piston machine according to the invention, FIG. 2 is an elevation of the gears on the line II—II in FIG. 1 with superposed control orifices of the second set, FIGS. 3 to 8 are elevations of the six plates forming the externally toothed gear, FIG. 9 is a diagrammatic elevation of the gears according to another example, FIG. 10 is a section along the line X—X in FIG. 9 and FIG. 11 is a diagrammatic elevation corresponding to FIG. 9 of the other side of the gears.

According to FIG. 1 a fixed housing 1 consists of an end plate 2, a bearing block 3, a side plate 4, an internally toothed gear 5, a further side plate 6 and an end plate 7. These parts are interconnected by screws, of which only the screw 8 is shown. A main shaft 9 has a sleeve like extension 10 mounted in the bearing block 3. The shaft is connected through a cardan shaft 11 to an externally toothed gear 12. The latter consists of six superposed plates 13 to 18.

As shown in FIG. 2, the internal gear 5 has an inner peripheral surface 19 in the form of a trocoid having the central axis $M_1$. One thereby obtains six teeth 20. The external gear 12 with five teeth 21 has a central axis $M_2$ spaced from the central axis $M_1$ by the distance e. The teeth 21 have the outer shape of a cylinder section which, as the effective circumferential section 22, lies against the circumferential surface 19 so that a total of five compression chambers 23 are formed, namely 23*a* to 23*e*. Between these effective circumferential sections 22, there are inoperative circumferential sections 24 which do not make contact with the internally toothed gear 5.

A distributing valve 25 is formed between the first plate 13 of the external gear 12 and the side plate 6. This distributing valve comprises control orifices 26 and auxiliary control orifices 27 of a first set in the plate 13 of gear 12 and control orifices 28 and 29 of a second set in the side plate 6. As is shown in FIG. 2, five control orifices 26*a* to 26*e* are provided in the region between the teeth, each defining an incision open towards the circumference. In the tooth regions disposed oppositely by 180°, there are auxiliary control orifices 27*a* to 27*e* consisting of an aperture and connected to the respective opposite compression chamber 23 by way of passage 30 indicated only in outline in FIG. 2. The control orifices 26 and auxiliary control orifices 27 lie on a circle about the central axis $M_2$ of gear 12.

The control orifices 28 and 29 of the second set lie on a circle about the central axis $M_1$ with a radius somewhat smaller than that of the circle on which the control orifices 26 and auxiliary control orifices 27 are disposed. The control orifices 28 are connected to a pressure connection 31 in end plate 7 in that they are connected to an annular groove 33 by way of radial passages 32 which, in turn, are connected to the pressure connection 31. The control orifices 29 are connected by way of radial passages 34 and an axial bore 35 to a vacuum connection 36 which is likewise provided in the end plate 7. Different cross-hatching indicates that the control orifices 28 and 29 are circumferentially alternately connected to the pressure and vacuum sides.

For the purpose of the following considerations, it is assumed that the rotary piston machine is operated as a motor. Corresponding considerations apply if it is used as a pump within the scope of a steering mechanism or the like.

FIG. 2 shows a position for the gears 5 and 12 where the instantaneous centre of rotation A is disposed at the bottom. The compression chambers 23*d* and 23*e* are under pressure because the control orifice 26*d* and the auxiliary control orifices 27*d* and 27*e* co-operate with control orifices 28. The compression chambers 23*a* and 23*b* are at container pressure because the associated control orifice 26*b* and the auxiliary control orifices 27*a* and 27*b* co-operate with control orifices 29. Switching over is just taking place in the case of the compression chamber 23*c* of maximum volume. This takes place rapidly because the control orifice 26*c* is moved counterclockwise at a high speed because of the large spacing from the instantaneous centre of rotation A. The opposite auxiliary control orifice 27*c*, which moves only slowly because of the adjacent instantaneous centre of rotation A, is in this case inoperative because it is disposed beyond the circle of orifices 28, 29. Upon rotation of the gear in the clockwise direction, the central axis $M_2$ at the same time planetates clockwise about the central axis $M_1$. The instantaneous centre of rotation is displaced to the left into the region of the control orifice 26*a*. Next, switching over of the compression chamber 23*a* takes place on reaching its lowest volume. This is effected in that the auxiliary control orifice 27*a* changes at a comparatively high speed from a control orifice 29 to a control orifice 28. The slowly moving control orifice 26*a* is in this case inoperative. The distributing valve 25 is therefore adapted to switch the pressure over in a very short time, both when reaching the maximum volume and when reaching the smallest volume of the compression chambers 23. Manufacturing inaccuracies which normally lead to commutating difficulties are completely eliminated. The rotary piston machine runs very uniformly, operates with little noise, avoids pressure peaks and has practically no losses in the compression volume.

FIGS. 3 to 8 illustrate the six plates 13 to 18 of which the externally toothed gear 12 is composed. As already mentioned, the first plate 13 comprises control orifices in the form of incisions 26 which directly form an opening 41 at the gear periphery and auxiliary control orifices in the form of apertures 27. The second plate is an apertured plate 14 with holes 37 on an outer circle aligned with the auxiliary control orifices 27. The third plate is a passage plate 15 with passage sections 38 extending over an angle and leading from a position flush with the holes 37 to a position on an inner circle with a communication to the holes 39 in a further apertured plate 16. The fifth plate is a distributing plate 17 with passage sections 40 which again extend over an angle from the position of the holes 39 and lead to openings 42 at the inoperative peripheral section 24 disposed diammetrally opposite to the auxiliary control orifice 27 connected thereto. The sixth plate, 18, covers these passage sections 40. The individual plates are desirably stamped from steel and soldered together. They may also consist of sintered metal.

In the FIGS. 9 to 11 embodiment, corresponding parts bear reference numerals increased by 100. The externally toothed gear 112 comprises four teeth 121. The internally toothed gear 105, of which only the inner periphery 119 is illustrated, comprises five teeth 120. This produces the compression chambers 123*a*, 123*b*, 123*c* and 123*d*. On one side of gear 112 there are four control orifices 126*a* to 126*d*, which directly form openings 141 provided on an inoperative section 124 of gear 112. On the opposite side, there are auxiliary control orifices 127*a* to 127*d* connected by way of corresponding passages 143 to openings 142 on the opposite side 143 of gear 112. The control orifices 128 and 129 of the second set are disposed at both sides of gear 121. One therefore obtains a first distributing valve 125 with the auxiliary control orifices 127*a* to 127*d* of the first set and the second control orifices 128 and 129 as well as a second distributing valve 125' with the control orifices 126*a* to 126*d* of the first set and the second control orifices 128' and 129'.

The gear 112 can, for example, be produced by sintering, the passages 143 being formed by inserted elongated lead members which are then melted out. The operation of this arrangement corresponding to that of FIG. 2 since only the relative motion of the two gears and the control orifices connected thereto is important, the externally toothed gear can also be fixed whilst the internally toothed gear rotates and planetates. Further, it is possible for one of the gears to turn and the other to planetate. Departures from the illustrated accurate 180° displacement between a control orifices and the associated auxiliary control orifice of the first set are possible so long as one obtains the desired rapid change from a second control orifice at pressure to a second control orifice at vacuum, or vice versa.

We claim:

1. A rotary piston machine comprising, a housing, inlet and outlet passage means, oppositely facing wall means in said housing, meshing externally and internally toothed gerotor type star and ring gears wherein said star gear rotates and gyrates relative to said ring gear to form expanding and collapsing chambers therebetween, said gears being between said wall means in sealing engagement therewith, said gears having parallel axes with the axis of said star gear being gyratable relative to the axis of said ring gear, shaft means for turning said star gear relative to said ring gear, said wall means having inlet and outlet sets of circumferentially and alternately arranged commutating supply and exhaust control orifices connected respectively to said inlet and outlet passage means, said star gear having at least one ring of control orifices concentric with said axis thereof and indexed relative to the crests of the teeth thereof, said one ring of orifices being commutatingly cooperable with said supply and exhaust orifices for supplying fluid to and exhausting fluid from said chambers, said star gear having chamber ports at the periphery thereof indexed so as to be between said tooth crests thereof and have fluid communication with said chambers, said one ring of orifices being respectively connected by passages with said chamber ports with the corresponding ones of said one ring of orifices being positioned on diametrically opposite sides of said star gear from the corresponding ones of said chamber ports.

2. A rotary piston machine according to claim 1 wherein all of said one orifices of said ring of control orifices are on the same end face of said star gear.

3. A rotary piston machine according to claim 1 wherein said commutating supply and exhaust orifices are in only one of said wall means.

4. A rotary piston machine according to claim 1 wherein said star gear includes a second ring of control orifices commutatingly cooperable with said supply and exhaust orifices for supplying fluid to and exhausting fluid from said chambers, said orifices of said second ring of orifices being respectively positioned on the same diametric sides of said star gear as corresponding ones of said chambers.

5. A rotary piston machine according to claim 4 wherein said control orifices are arranged on circles, said supply and exhaust orifices having the same spacing from the axis of said internally toothed gear as said one and second rings of orifices have from the axis of said externally toothed gear.

6. A rotary piston machine according to claim 4 wherein said externally toothed gear comprises a plurality of superposed plates, said plates including said rings of orifices and said chamber ports, at least two of said plates having passages between said one ring of orifices and said chamber ports.

7. A rotary piston machine according to claim 4 wherein said star gear has an odd number of teeth, said one ring of control orifices being indexed in alignment with said crests thereof and said second ring of orifices being symmetrically indexed with an alternate arrangement relative to said crests thereof.

8. A rotary piston machine according to claim 7 wherein said one and second rings of control orifices are on the same side of said star gear.

9. A rotary piston machine according to claim 8 wherein said supply and exhaust orifices are in one of said wall means in fluid communication with said one and second rings of control orifices.

10. A rotary piston machine according to claim 4 wherein said star gear has an even number of teeth and said one and second rings of control orifices symmetrically indexed with an alternate arrangement relative to said crests thereof.

11. A rotary piston machine according to claim 10 wherein said one and second rings of control orifices are on opposite sides of said star gear.

12. A rotary piston machine according to claim 11 including first and second sets of said supply and exhaust orifices respectively in said oppositely facing wall means.

13. A rotary piston machine according to claim 1 wherein said star gear has an odd number of teeth and said one ring of control orifices is indexed in alignment with said crests thereof.

14. A rotary piston machine according to claim 1 wherein said star gear has an even number of teeth and said one ring of control orifices is symmetrically indexed with an alternate arrangement relative to said crests thereof.

* * * * *